United States Patent [19]

Winslow

[11] 4,429,729

[45] Feb. 7, 1984

[54] WINDOW SHADE CLUTCH ASSEMBLY

[75] Inventor: Randy Winslow, Ripley, Tenn.

[73] Assignee: Clopay Corporation, Cincinnati, Ohio

[21] Appl. No.: 396,649

[22] Filed: Jul. 9, 1982

[51] Int. Cl.[3] ..... E06B 9/20

[52] U.S. Cl. ..... 160/315; 160/295; 185/43

[58] Field of Search ..... 160/291, 294, 295, 296, 160/300, 301, 305, 313, 315, 318, 323–326; 185/13, 43; 242/107.5

[56] References Cited

U.S. PATENT DOCUMENTS

| | | | |
|---|---|---|---|
| 350,656 | 10/1886 | Brooks . | |
| 662,753 | 11/1900 | Bell | 160/295 |
| 718,178 | 1/1903 | Vickery | 160/315 |
| 778,660 | 12/1904 | Hadden | 160/295 |
| 823,452 | 6/1906 | Vickery | 160/295 |
| 873,438 | 12/1907 | John, Jr. . | |
| 982,444 | 1/1911 | Smith . | |
| 1,052,689 | 2/1913 | Pitman | 185/43 |
| 1,127,134 | 2/1915 | Wehinger | 185/43 |
| 1,283,386 | 10/1918 | Wenzelmann . | |
| 1,502,197 | 7/1924 | Hill . | |
| 1,630,770 | 5/1927 | Smith | 160/295 |
| 1,938,729 | 12/1933 | Traut | 160/318 |
| 1,942,320 | 1/1934 | Young | 160/295 |
| 2,350,286 | 5/1944 | Michelman . | |
| 2,619,199 | 11/1952 | Muard et al. | 185/43 |
| 3,763,916 | 10/1973 | Gossling . | |
| 4,346,749 | 8/1982 | Singleton et al. | 160/301 |

*Primary Examiner*—Peter M. Caun

*Attorney, Agent, or Firm*—Wood, Herron & Evans

[57] ABSTRACT

A clutch assembly is provided to prevent over tensioning of the spring motor of a window shade. The clutch assembly includes sleeve means, connected to one end of the spring motor, having an axial bore formed with internal threads which are engageable with threads formed along the window shade dowel, and also having sleeve locking means operable to engage retaining means formed on the interior surface of the window shade tube. The clutch assembly is operable to permit tensioning of the spring motor a predetermined number of turns of the window shade tube in one direction and then prevent further tensioning of the spring motor without restricting rotation of the tube in such one direction.

26 Claims, 6 Drawing Figures

WINDOW SHADE CLUTCH ASSEMBLY

FIELD OF THE INVENTION

This invention relates generally to the area of window shades, and, more particularly, to a clutch mechanism capable of preventing over tensioning of the spring motor to avoid potential failure.

BACKGROUND OF THE INVENTION

Devices for the protection of over tensioning in spring motors for window shades and other devices have been in use for many years. One common approach to this problem is found in various forms in U.S. Pat. Nos. 350,656 to Brooks, 823,452 to Vickery, 873,438 to John, and 982,444 to Smith. Each of these patents disclose some form of a nut or other internally threaded element which is movable along a threaded shaft in response to the rotation of the shaft. A spring is fixed to the shaft and is tensioned or unwound with the rotation thereof in a given direction. The nut is positioned on the shaft so that it will engage a stop at a predetermined point when the desired number of turns of the shaft is reached. This predetermined point is made to correspond to the maximum tension which can be imposed on the spring motor without damage. Once the designated number of rotations is reached, further rotation of the shaft is prevented by engagement of the nut or other movable member with the stop.

Another approach is found in U.S. Pat. No. 1,052,689 to Pitman. In this patent, an elongated shaft is provided having a threaded portion at one end and an attachment means at the other end. A spring, acting as the motor for the window shade, is secured to the attachment means of the elongated shaft. A drum having internal threads is disposed along the threaded portion of the shaft and movable axially therealong in response to rotation of the shaft. The other end of the spring is attached to the drum, and thus, movement of the drum in one direction will cause the spring to tension and in the other direction to unwind. Means are provided to engage the drum and prevents its axial movement after a desired number or rotations of the shafts so as to provide a fixed stop to prevent the spring motor from being tensioned beyond a predetermined amount.

One limitation of each of the devices described above is that they are rather bulky in configuration and may not be readily adapted to the streamlined tubes which house modern day window shade devices. In addition, each of these over tensioning means provides a fixed stop which restricts the shaft from any further rotation in the direction in which the spring is tensioned. It is contemplated that this could present a practical problem in the use of window shades embodying such devices, particularly by those not familiar with their operation. Once the point where the stop engages is reached, the user could inadvertently pull further on the shade and create severe damage to the entire window shade assembly.

It has therefore been an object of this invention to provide a clutch mechanism which prevents over tensioning of the spring motor of a window shade without creating a positive stop which restricts further rotation of the shaft on which the spring motor is disposed.

It is another object of this invention to provide a window shade motor having a clutch mechanism which is streamlined in configuration and may be easily inserted within the current designs of window shade assemblies.

SUMMARY OF THE INVENTION

These and other objects are accomplished by the clutch assembly of this invention adapted for use in a window shade including a rotatable tube, a dowel disposed longitudinally within the tube and fixed relative thereto, and a spring motor attaching to one end of the dowel. The clutch assembly consists of a sleeve means connected to the other end of the spring motor and having an axial bore with internal threads which are engageable with external threads formed along at least a portion of the dowel. The sleeve means includes shaft locking means engageable with retaining means formed on the interior surface of the tube so as to permit rotation of the sleeve means with the tube.

The sleeve locking means, in various embodiments as discussed below, is operable to engage the retaining means of the tube and permit rotation of the sleeve means relative to the dowel a predetermined number of turns in the clockwise direction while the dowel is held in a fixed position. Since one end of the spring motor is rotating with the sleeve means and tube but the other end is held from rotation by its connection to the dowel, the spring motor is tensioned by such clockwise rotation of the sleeve means. In addition, during such rotation, the sleeve means moves axially along the dowel due to their threaded engagement with one another.

Once a predetermined number of revolutions of the sleeve means is reached, corresponding to the preferred tension which may safely be applied to the spring motor, the sleeve locking means is operable to disengage from the tube retaining means. Once the sleeve locking means is disengaged from the retaining means, the spring motor causes it to rotate in the counterclockwise direction so that the sleeve locking means re-engages the tube retaining means. Further clockwise rotation of the tube results in alternating clockwise—counterclockwise rotation of the sleeve means preventing overtensioning of the spring motor. When the spring motor is allowed to unwind by reversing the direction of rotation of the tube, the sleeve locking means is operable to maintain engagement with the tube retaining means and move axially in the opposite direction along the dowel in preparation for another winding and unwinding operation.

DESCRIPTION OF THE DRAWINGS

The structure, operation and advantages of this invention will become apparent upon consideration of the following discussion taken in conjunction with the accompanying drawings wherein.

DESCRIPTION OF THE INVENTION

Figures 1, 2, 3, 4, 5, 6:
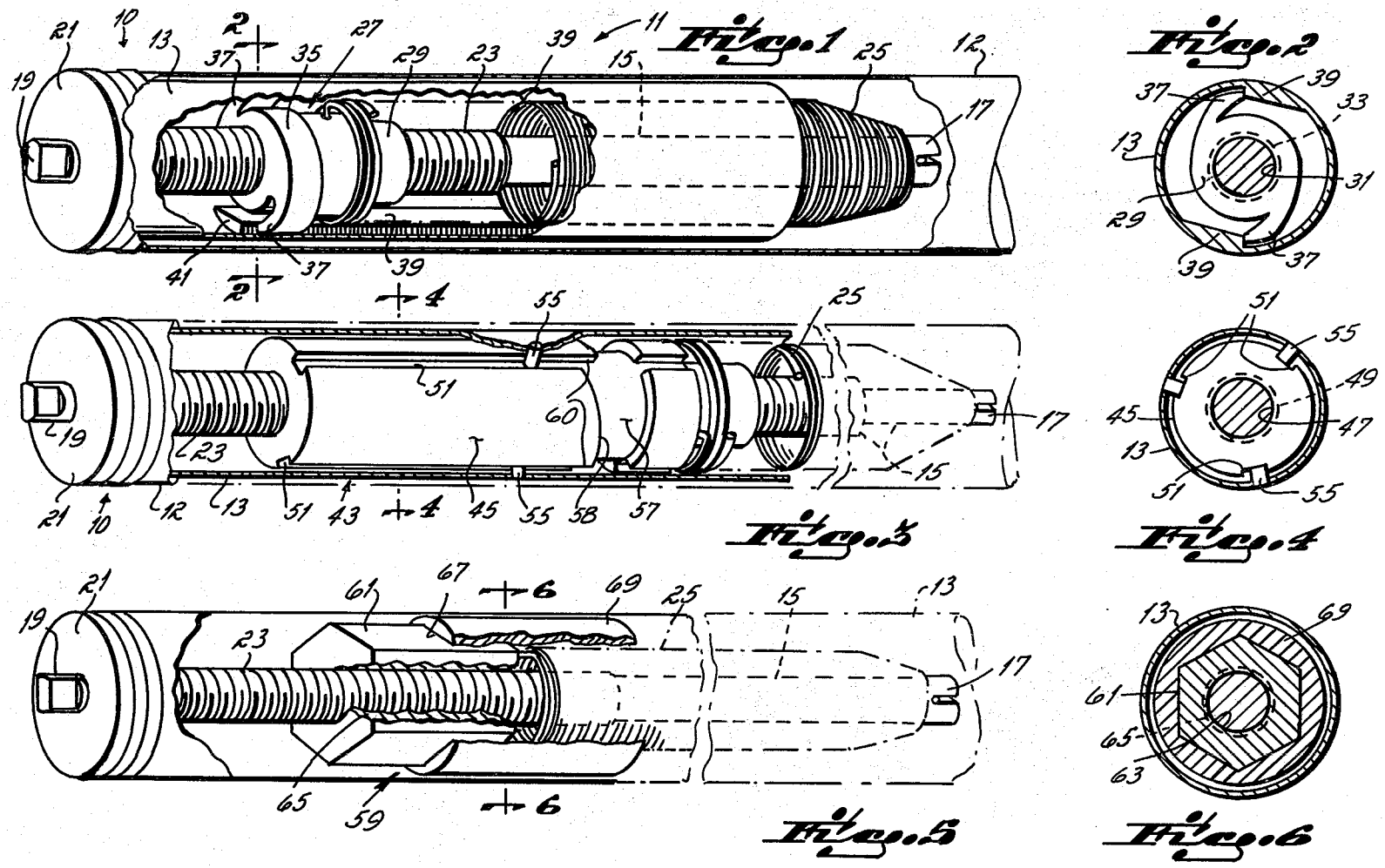
FIG. 1 is a perspective view in partial cross-section of one embodiment of the clutch mechanism herein adapted with the spring motor of a window shade.
FIG. 2 is a cross-sectional view in full elevation taken generally along line 2—2 of FIG. 1.
FIG. 3 is a perspective view in partial cross-section of a second embodiment of the clutch mechanism of this invention.
FIG. 4 is a cross-sectional view in full elevation taken generally along line 4—4 of FIG. 3.
FIG. 5 is a perspective view in partial cross-section of still another embodiment of the clutch mechanism herein.
FIG. 6 is a cross-sectional view in full elevation taken generally along line 6—6 of FIG. 5.

Referring now to the drawings and in particular to FIGS. 1 and 2, one embodiment of the clutch assembly of this invention is shown. In discussing the various embodiments of the clutch assembly herein, one type of window shade 11 is shown in the drawings but it should be understood that other types of window shades such as a flush mount motor window shade may be utilized with this invention. Window shade 11 includes a tube assembly 10 including an outer tube 12 and an inner tube 13 in which an elongated shaft or dowel 15 is longitudinally disposed. The dowel 15 is formed with a dovetail 17 at one end and a spear 19 at the other end with the spear extending through an end cap 21 as shown. The spear 19 engages one of two mounting brackets (not shown) which support the window shade, and acts to prevent the dowel 15 from rotating. The dowel 15 is formed with external threads 23 along at least a portion of its length adjacent the end having spear 19. The dovetail 17 end of dowel 15 is attached to a spring motor 25 which is concentrically disposed over dowel 15 along at least a portion of its length. The other end of the spring motor 25 is attached for rotation to the clutch assembly of this invention, which in turn is rotatable with tube 13 as discussed in detail below.

In operating window shade 11, the spring motor 25 is first tensioned as the fabric protion of the window shade 11 (not shown) is moved downwardly, and then released to unwind and wrap the fabric about the tube as it is moved upwardly. The tube 13 is rotatable first in one direction and then in the opposite direction as the fabric portion of the window shade 11 is raised and lowered. Although not shown in the drawings, catch means are provided to stop the rotation of tube 13 so as to position the fabric portion of window shade 11 as desired. Since upward movement of the window shade 11 is dependent upon the rotationof tube 13 induced by unwinding of spring motor 25, it is crucial to the operation of window shade 11 that the spring motor 25 be protected from damage due to over tensioning. Although positive stops have been proposed to protect the spring motor such as disclosed in the prior art mentioned above, such devices have been found to inadequately solve the problem.

One embodiment of the clutch assembly of this invention shown in FIGS. 1 and 2 is labeled generally with the reference 27. In this embodiment, clutch assembly 27 includes a sleeve 29 having a longitudinal bore 31 which is formed with threads 33 on the interior surface thereof. The internal threads 33 of sleeve 29 are engageable with the threads 23 of dowel 15 so that the sleeve 29 is axially movable along the fixed dowel 15. One end of the sleeve 29 is secured to the free end of spring motor 25, and the other end of sleeve 29 includes a raised section 35 along which at least two generally curved blades 37 are disposed and spaced 180° apart. See FIG. 2.

Tube 13 includes at least two elongated ledges or shoulders 39 which extend outwardly from the interior surface thereof. As discussed below, the shoulders 39 are operable to engage the blades 37 of sleeve 29 so that the sleeve 29 is rotatable with the tube 13. To that end, the number and spacing of shoulders 39 within tube 13 corresponds to the number and spacing of blades 37 on shaft 29. Although only two blades 37 and two shoulders 39 are illustrated in the drawings, three or more blades 37 and shoulders 39 could be utilized and are considered to be within the scope of this invention.

As mentioned above, it is necessary for the proper operation of window shade 11 to protect spring motor 25 from damage due to cover tensioning. The purpose of clutch assembly 27 is to prevent such over tensioning without providing a positive stop or a point at which no further rotation of the sleeve 29 and spring motor 25 can occur as in prior art designs. The structure of clutch assembly 27 which accomplishes this function may be better appreciated by considering one lowering and raising operation of window shade 11.

As the fabric portion (not shown) of window shade 11 is initially lowered, the tube 13 rotates in a clockwise direction according to the configuration of window shade 11 shown in FIGS. 1 and 2. At this point, the sleeve 29 is disposed along dowel 15 such that the blades 37 of sleeve 29 engage the shoulders 39 of tube 13. Due to this connection between the sleeve 29 and tube 13, the sleeve 29 rotates with the tube 13 as the fabric portion of the window shade 11 is lowered. Since one end of the spring motor 25 is connected to the fixed dowel 15 and the other end to the rotating sleeve 29, the spring motor 25 is tensioned as the tube 13 and sleeve 29 are rotated in a clockwise direction. During this clockwise rotation of the tube 13, sleeve 29 moves axially along the fixed dowel 15 toward its spear 19 end due to the engagement of internal threads 33 of sleeve 29 with threads 23 of dowel 15. The blades 37 of sleeve 29 continue to maintain contact with the shoulders 39 of tube 13 as sleeve 29 moves along dowel 15.

Tensioning of spring motor 25 continues until the blades 37 reach the end or release point 41 of tube shoulders 39. Once disengaged from the shoulders 39, the spring motor 25 then rotates sleeve 29 in the counterclockwise direction approximately one-half revolution so that the blades 37 again engage shoulders 39. Further clockwise rotation of tube 13, and in turn sleeve 29, causes the sleeve 29 to alternately disengage from the tube shoulders 39 and then rotate in the counterclockwise direction by operation of the tensioned spring motor 25 until the blades 37 re-engage the shoulders 39. In this manner, the spring motor 25 is protected from over tensioning because clockwise rotation of the sleeve 29 is prevented once sleeve 29 moves axially to the end point 41 of shoulders 39. The spring motor 25 cannot be tensioned further since neither end is being rotated. Unlike prior art devices to prevent over tensioning, this invention provides no positive stop or point at which no further rotation of tube 13 is permitted.

The amount of tension which the spring motor 25 is allowed to receive is controlled and can be adjusted to accommodate springs of different ultimate tension. As discussed above, the spring motor 25 is tensioned by the rotation of sleeve 29 with tube 13 since one end of the spring motor 25 is attached to the rotatable sleeve 29 and the other to the fixed dowel 15. This tensioning continues until the sleeve 29 moves axially along dowel 15 to the end point 41 where the blades 37 disengage shoulders 39 of tube 13. At this point the sleeve 29 no longer maintains continuous engagement with the tube 13, but alternately engages and disengages the tube 13 so as to prevent further tensioning of spring motor 25.

The axial length of travel of sleeve 29 along dowel 15 to the point of disengagement of blades 37 and shoulders 39 is fixed according to the tension which may preferably be applied to spring motor 25 in accordance with manufacturer's specifications or other design criteria. For a given amount of tension to be applied to spring motor 25, the sleeve 29 is initially threaded onto the dowel 15 an appropriate axial distance from the end point 41 of shoulders 39. This axial distance may also be expressed in terms of the number of revolutions of sleeve 29 necessary to move sleeve 29 to the appropriate axial position along dowel 15. Regardless of the tension permitted for various spring motors 25, the sleeve 29 can be positioned at the proper axial distance from the end point 41 of shoulders 39 so that when tube 13 is rotated in a clockwise direction the sleeve 29 will rotate only those number of turns needed to obtain the correct tension on spring motor 25 and then reach the end point 41 of shoulders 39 where no further tensioning of spring motor 25 can occur.

Once the amount of downward motion of window shade 11 is completed with the spring motor 25 tensioned to a maximum extent, the fabric portion of the window shade 11 may be released. This enables the spring motor 25 to unwind which in turn causes the tube 13 to rotate in a counterclockwise direction. As mentioned above, within less than about one revolution of sleeve 29, the spring motor 25 urges blades 37 of sleeve 29 back into engagement with shoulders 39 to restrict further rotational movement of the sleeve 29 apart from the tube 13. Additional blades 37 could be added to shaft 29 to reduce the amount of counterclockwise rotation of sleeve 29 with respect to the tube 13 before engagement with shoulders 39. As is apparent, the more blades 37 provided, the less sleeve 29 would be permitted to rotate before the blades 37 engage shoulders 39. Since the sleeve 29, and in turn tube 13, continue to rotate after blades 37 engage shoulders 39, the spring motor 25 unwinds as the sleeve 29 moves axially toward the dovetail end 17 of dowel 15 to assume its original position along shoulders 39 in preparation for another lowering and raising operation.

Referring now to FIGS. 3–6, alternate embodiments of the clutch assembly herein are shown. Generally, each operate using the same principle as discussed above in connection with the FIGS. 1 and 2 embodiment. Considering first the embodiment of FIGS. 3 and 4, a clutch assembly according to this invention is shown and labeled generally with the reference numeral 43. Clutch assembly 43 includes an elongated sleeve 45 having a longitudinal bore 47 formed with threads 49 along the interior surface thereof. The threads 49 are engageable with the external threads 23 of dowel 15 so as to dispose shaft 45 therealong and permit movement of sleeve 45 axially along dowel 15. Sleeve 45 is attached to the other end of spring motor 25 and has an exterior surface formed with at least one groove 51 extending longitudinally therealong. As shown in FIG. 4, sleeve 45 may be provided with three grooves 51 spaced 120° apart, or, in the alternative, other numbers of grooves could be utilized as desired. The grooves 51 are engageable with a pin 55 mounted to the tube 13 and extending downwardly into the interior thereof. The grooves 51 terminate in an annulus 57 which extends along the circumference of sleeve 45 and is formed with tapered edge 58 having an offset 60.

The operation of clutch assembly 43 is essentially identical to that of clutch assembly 27 discussed above. However, in this embodiment, the sleeve 45 rotates with the tube 13 by the engagement of pin 55 within grooves 51 for the tensioning spring motor 25. After the sleeve 45 has traveled axially along dowel 15 a predetermined distance, the pin 55 disengages groove 51. The tensioned spring motor 25 then rotates sleeve 45 in the counterclockwise direction so that the pin 55 first rides along the tapered edge 58 of annulus 57 and then contacts the offset 60 in one of the three grooves 51 shown in the drawings, within less than one revolution of sleeve 45. As in the previous embodiment, the sleeve 45 is released from rotation with tube 13 in the clockwise direction by disengagement of a retaining means of the tube 13, pin 55, with a locking means of the sleeve 45, grooves 51. This prevents over tensioning of the spring motor 25 since sleeve 45 is not permitted to rotate in a clockwise direction once pin 55 is moved axially to the annulus 57. The amount of tension applied to spring motor 25 is controlled in this embodiment as in the prior embodiment by threading sleeve 45 a predetermined axial distance along dowel 15 from annulus 57, which is the point of disengagement of sleeve 45 and tube 13. This axial distance may be lengthened to accommodate spring motors 25 requiring higher tension, or shortened for spring motors 25 which should be tensioned to a lesser extent.

Where three grooves 51 are formed in sleeve 45 as shown, the sleeve 45 will rotate in a counterclockwise or reverse direction in response to unwinding of spring motor 25 no more than about one-third of a turn before the pin 55 again engages one of the offsets 60 in grooves 51. Such reverse rotation could be reduced by simply adding more grooves 51 to the sleeve 45. When the downward motion of the window shade 11 is completed and the tube 13 is permitted to be rotated in the opposite direction for raising the shade, sleeve 45 moves axially along dowel 15 in the opposite direction toward spear 19, as spring motor 25 unwinds, with pin 55 riding within a groove 51 throughout such axial movement.

A third embodiment of this invention is shown in FIGS. 5 and 6 in which a clutch assembly labeled generally with reference numeral 59 is provided. Clutch assembly 59 includes a sleeve 61 having a longitudinal bore 63 with the interior surface thereof being formed with threads 65. The movement of sleeve 61 along the threaded portion of dowel 15 is similar to that described above in connection with the previous embodiments. The exterior surface of sleeve 61 is formed in a generally hexagon shape for engagement within the similarly shaped interior surface 67 of a sleeve 69 which is concentrically disposed within tube 13. Although a sleeve 69 is shown in the drawings it should be understood that the interior surface of tube 13 could be shaped in a manner similar to the sleeve interior surface 67, and sleeve 69 is thus shown for purposes of illustration of the concept herein. The exterior surface of sleeve 61 and interior surface 67 of sleeve 69 are formed to mate with one another so as to permit rotational movement of shaft 61 with tube 13 when such surfaces are in contact. While a hexagonal shape is shown in FIGS. 5 and 6, the exterior surface of sleeve 61 and interior surface 67 of sleeve 69 could be formed in essentially any configuration so that at least one surface of the sleeve 61 and sleeve 69 mate together. For example, the shape of sleeve 61 and sleeve 69 could be modified by forming a groove (not shown) in sleeve 69 and a correspondingly shaped, mateable key (not shown) on the exterior surface of sleeve 61.

As in the previous embodiments, the spring motor 25 is attached for rotation to one end of sleeve 61 and is attached at the other end to the fixed dowel 15. The spring motor 25 is tensioned as sleeve 61 rotates with tube 13 in one direction and moves axially along dowel 15. When the sleeve 61 moves outwardly from the interior surface 67 of sleeve 69, the spring motor 25 partially unwinds to rotate tube 13 in a counterclockwise direction so that tube 13 moves axially into engagement with the sleeve 69. As in the previous embodiments, the successive engagement and disengagement of sleeve 61 and sleeve 69 continues as long as tube 13 is rotated in a clockwise direction once sleeve 61 has moved axially along dowel 15 to the point where the retaining means of the tube 13, sleeve 69, no longer maintains continuous contact with the locking means or exterior surface of the sleeve 61. When the spring motor 25 is allowed to unwind and rotate the tube 13 in the opposite direction for raising the window shade 13, the sleeve 61 maintains continuous engagement with the interior surface 67 of sleeve 69 and moves axially along dowel 15 with the rotation of tube 13.

Although the invention has been described in terms of a certain preferred embodiment, persons skilled in the art to which this invention pertains will readily appreciate modifications and changes which may be made without departing from the spirit of the invention. Therefore, I do not intend to be limited except by the scope of the appended claims.

Thus having described the invention, what is claimed is:

1. An assembly for preventing over tensioning of a spring motor means in a window shade comprising:

stationary means connected to said spring motor means;

rotation means rotatable in a first and second direction relative to said stationary means, said rotation means being connected to said spring motor means, said spring motor means being tensioned with the rotation of said rotation means in said first direction; and means for preventing further tensioning of said spring motor means at a selected tension thereof while permitting said rotation means to continue to rotate in said first direction.

2. An assembly for preventing over tensioning of a spring motor means in a window shade comprising:

stationary means connected to said spring motor means;

rotation means rotatable in a first and second direction relative to said stationary means, said rotation means being connected to said spring motor means, said spring motor means being tensioned with the rotation of said rotation means in said first direction; and clutch means operable to permit said rotation means to tension said spring motor means to a selected tension thereof, and to prevent further tensioning of said spring motor means by said rotation means in excess of said selected tension while allowing said rotation means to continue to rotate in said first direction.

3. In combination, a window shade tube assembly comprising a fixed dowel connected to a spring motor, a tube disposed about said fixed dowel and connected to said spring motor, said tube being rotatable in a first and second direction, said spring motor being tensioned with the rotation of said tube relative to said fixed dowel in said first direction; and a clutch means operable to permit said tube to tension said spring motor to a selected tension thereof, and to prevent further tensioning of said spring motor by said tube in excess of said selected tension while allowing said tube to continue to rotate in said first direction.

4. In combination, a tube assembly comprising a rotatable housing, retaining means associated with said housing, said retaining means providing a release point, a fixed shaft disposed longitudinally within said housing, and spring motor means attaching at one end to said fixed shaft; and a clutch assembly comprising sleeve means movable axially along said shaft, the other end of said spring motor attaching to said sleeve means, sleeve locking means associated with said sleeve means, said sleeve means operable to engage said retaining means of said housing for rotation of said sleeve means with said housing in a first and second direction;

said sleeve means moving axially in one direction along said shaft as said housing rotates in said first direction with said sleeve locking means maintaining continuous engagement with said retaining means for tensioning said spring motor;

said sleeve locking means being operable to alternately disengage and engage said retaining means at said release point of said retaining means to prevent further rotation of said sleeve means with said housing in said first direction for avoiding further tensioning of said spring motor;

said sleeve locking means being operable to engage said retaining means as said sleeve rotates in said second direction, said sleeve means moving axially in the opposite direction of said one direction along said sleeve means as said housing rotates in said second direction while said sleeve locking means maintains engagement with said retaining means, the tension on said spring motor being released as said housing rotates in said second direction and said sleeve means moves along said shaft in said opposite direction.

5. In combination, a tube assembly comprising a rotatable housing, shoulder means disposed along at least a portion of the interior of said housing, said shoulder means providing a release point, a fixed shaft disposed longitudinally within said housing, spring motor means attaching at one end to said fixed shaft; and a clutch assembly comprising sleeve means movable axially along said shaft, the other end of said spring motor attaching to said sleeve means, extension means extending outwardly from said sleeve means, said extension means operable to engage said shoulder means of said housing for rotation of said sleeve means with said housing in a first and second direction;

said sleeve means moving axially in one direction along said shaft as said housing rotates in said first direction with said extension means maintaining continuous engagement with said shoulder means for tensioning said spring motor;

said extension means being operable to alternately disengage and engage said shoulder means at said release point of said shoulder means to prevent further rotation of said sleeve means with said housing in said first direction for avoiding further tensioning of said spring motor;

said shoulder means being operable to engage said extension means as said housing rotates in said second direction, said sleeve means moving axially in the opposite direction of said one direction along said shaft as said housing rotates in said second direction while said extension means maintains engagement with said shoulder means, the tension on said spring motor being released as said housing rotates in said second direction and said sleeve means moves along said shaft in said opposite direction.

6. The combination of claim 5 wherein said shoulder means is at least two elongated ledges spaced from one another and extending outwardly from the interior surface of said housing.

7. The combination of claim 5 wherein said extension means is at least two generally curved blade sections engageable with said shoulder means.

8. The combination of claim 5 wherein said housing is a tube.

9. In combination, a tube assembly comprising a rotatable housing, pin means mounted to and extending into the interior of said housing, said pin means providing a release point, a fixed shaft disposed longitudinally within said housing, spring motor means attaching at one end to said fixed shaft; and a clutch assembly comprising sleeve means movable axially along said shaft, the other end of said spring motor attaching to sleeve means, at least one elongated groove formed longitudinally along the exterior surface of said sleeve means, said groove being operable to engage said pin means of said housing for rotation of said sleeve means with said housing in a first and second direction;

said sleeve means moving axially in one direction along said shaft as said housing rotates in said first direction with said groove maintaining continuous engagement with said pin means for tensioning said spring motor;

said groove being operable to alternately disengage and engage from said pin means at said release point to prevent further rotation of said sleeve means with said housing in said first direction for avoiding further tensioning of said spring motor;

said groove being operable to engage said pin means as said housing rotates in said second direction, said sleeve means moving axially in the opposite direction of said one direction along said shaft as said housing rotates in said second direction while said groove maintains engagement with said pin means, the tension on said spring motor being released as said housing rotates in said second direction and said sleeve means moves along said shaft in said opposite direction.

10. The combination of claim 9 wherein said sleeve means is formed with three elongated grooves approximately 120° apart.

11. The combination of claim 9 wherein said housing is a tube.

12. In combination, a tube assembly comprising a rotatable housing, retaining means disposed in the interior of said housing having a shaped interior surface, said retaining means providing a release point, a fixed shaft disposed longitudinally within said housing, spring motor means attaching at one end to said fixed shaft; and a clutch assembly comprising sleeve means movable axially along said shaft, the other end of said spring motor attaching to said sleeve means, said sleeve means having a shaped exterior surface formed for insertion in and engagement with the shaped interior surface of said retaining means, said shaped exterior surface being operable to engage said retaining means of said housing for rotation of said sleeve means with said housing in a first and second direction;

said sleeve means moving axially in one direction along said shaft as said housing rotates in said first direction with said shaped exterior surface maintaining continuous engagement with said retaining means for tensioning said spring motor;

said shaped exterior surface being operable to alternately disengage and engage said retaining means at said release point to prevent further rotation of said sleeve means with said housing in said first direction for avoiding further tensioning of said spring motor;

said shaped exterior surface being operable to engage said retaining means as said housing rotates in said second direction, said sleeve means moving axially in the opposite direction of said one direction along said shaft as said housing rotates in said second direction while said shaped exterior surface maintains engagement with said retaining means, the tension on said spring motor being released as said housing rotates in said second direction and said sleeve means moves along said shaft in said opposite direction.

13. The combination of claim 12 wherein said retaining means has an interior surface formed in a hexagon shape and said shaped exterior surface of said sleeve means is formed in a hexagon shape.

14. The combination of claim 12 wherein the interior surface of said retaining means and the exterior surface of said sleeve means are formed with at least one engaging, mateable surface for preventing rotation of one relative to the other.

15. The combination of claim 12 wherein said housing is a tube.

16. In combination, a tube assembly comprising a rotatable tube, retaining means associated with said tube, said retaining means providing a release point, a fixed shaft concentrically disposed within said housing, said shaft being formed with exterior threads along at least a portion thereof, spring motor means concentrically disposed about said shaft and having one end attached thereto; and a clutch assembly comprising sleeve means movable axially along said shaft, the other end of said spring motor attaching to said sleeve means, sleeve locking means associated with said sleeve means, said sleeve locking means operable to engage said retaining means of said tube for rotation of said sleeve means with said tube in a first and second direction;

said sleeve means moving axially in one direction along said shaft as said tube rotates in said first direction with said sleeve locking means maintaining continuous engagement with said retaining means for tensioning said spring motor;

said sleeve locking means being operable to alternately disengage and engage said retaining means at said release point of said retaining means to prevent further rotation of said sleeve means with said tube in said first direction for avoiding further tensioning of said spring motor;

said sleeve locking means being operable to engage said retaining means as said tube rotates in said second direction, said sleeve means moving axially in the opposite direction of said one direction along said shaft as said tube rotates in said second direction while said sleeve locking means maintains engagement with said retaining means, the tension on said spring motor being released as said tube rotates in said second direction and said sleeve means moves along said shaft in said opposite direction.

17. The combination of claim 16 wherein said retaining means is at least two elongated ledges spaced from one another, and said sleeve locking means is at least two blades extending outwardly from said sleeve means and being engageable with said at least two elongated ledges.

18. The combination of claim 16 wherein said retaining means is a pin and said sleeve locking means is at least one groove formed in said sleeve means to receive said pin.

19. The combination of claim 16 wherein said retaining means is a sleeve section and said sleeve locking means is a shaped exterior surface of said sleeve means, said sleeve section and said shaped exterior surface of said sleeve means having at least one mateable surface for preventing rotation of one relative to the other.

20. An assembly for preventing over-tensioning of a spring motor means in a window shade comprising:

a fixed shaft;

a housing rotatable relative to said fixed shaft;

spring motor means contained within said housing, said spring motor means being connected to said fixed shaft;

sleeve means axially movable along said shaft, said sleeve means being connected to said spring motor means;

clutch means interconnecting said sleeve means and said housing;

said sleeve means being movable in a first direction along said shaft while rotating with said housing to effect increased tensioning of said spring motor means, said clutch means being adapted to drivingly disengage said sleeve means from said housing so as to prevent further tensioning of said spring motor means.

21. An assembly for preventing over-tensioning of a spring motor means in a window shade coamprising:

a fixed shaft;

a housing rotatable relative to said fixed shaft;

spring motor means contained within said housing, said spring motor means being connected to said fixed shaft;

sleeve means axially movable along said shaft, said sleeve means being connected to said spring motor means;

clutch means interconnecting said sleeve means and said housing;

said sleeve means being movable in a first direction along said shaft while rotating with said housing to effect increased tensioning of said spring motor means, said clutch means being adapted to drivingly disengage said sleeve means from said housing at a predetermined point of axial movement of said sleeve means in said first direction so as to prevent further tensioning of said spring motor means.

22. The assembly of claim 21 wherein at least a portion of said fixed shaft includes external threads.

23. The assembly of claim 21 wherein said clutch means comprises retaining means associated with said housing and locking means associated with said sleeve means, said retaining means and said locking means being adapted to releasably engage one another.

24. The assembly of claim 23 wherein said retaining means includes at least two elongated, spaced ledges mounted to said housing, and said locking means includes at least two blade sections mounted to said sleeve means and engageable with said ledges.

25. The assembly of claim 23 wherein said retaining means is a pin mounted to said housing and said locking means is a groove formed in said sleeve means and engageable with said pin.

26. The assembly of claim 23 wherein said retaining means is a sleeve section having an interior surface mounted within said housing, and said locking means is a shaped exterior surface formed on the exterior of said sleeve means and being adapted to be disposed within and mate with said interior surface of said sleeve section.

* * * * *